US008538292B2

(12) United States Patent
Chueh et al.

(10) Patent No.: US 8,538,292 B2
(45) Date of Patent: Sep. 17, 2013

(54) IMAGE FORMING APPARATUS WITH SUPPORTING MEMBER SET AND FORCE-EXERTING MEMBER SET INTERACTING WITH EACH OTHER

(75) Inventors: Chuang-Hua Chueh, Hsin Chu (TW); Katsuhiko Gotoda, Hsinchu (TW)

(73) Assignee: Avision Inc. (TW)

( * ) Notice: Subject to any disclaimer, the term of this patent is extended or adjusted under 35 U.S.C. 154(b) by 291 days.

(21) Appl. No.: 13/073,117

(22) Filed: Mar. 28, 2011

(65) Prior Publication Data

US 2011/0243605 A1 Oct. 6, 2011

(30) Foreign Application Priority Data

Mar. 31, 2010 (TW) ..... 99109793 A

(51) Int. Cl.
*G03G 15/00* (2006.01)

(52) U.S. Cl.
USPC ..... 399/119

(58) Field of Classification Search
USPC ..... 399/119, 116
See application file for complete search history.

(56) References Cited

U.S. PATENT DOCUMENTS 5,202,739 A * 4/1993 Hatakeyama et al. ..... 399/226
2009/0317130 A1* 12/2009 Ishikawa et al. ..... 399/116

* cited by examiner

*Primary Examiner* — Quana M Grainger

(57) ABSTRACT

An image forming apparatus includes a case, a photosensitive drum, a developing cartridge, a supporting member set, a force-exerting member set and a resilient member. The photosensitive drum forms a toner image. The developing cartridge, movably disposed within the case, includes a developing tank and a developing roller. The developing roller, mounted on the developing tank and positioned opposite the photosensitive drum, transfers toners to the photosensitive drum. The supporting member set is disposed on an inner wall of the case. The force-exerting member set, disposed on an outer wall of the developing tank, interacts with the supporting member set to maintain steady contact pressure between the developing roller and the photosensitive drum. The resilient member, disposed between the developing tank and the case, provides a restoring force for counteracting a weight of the developing tank and urging the developing roller towards the photosensitive drum.

11 Claims, 6 Drawing Sheets

IMAGE FORMING APPARATUS WITH SUPPORTING MEMBER SET AND FORCE-EXERTING MEMBER SET INTERACTING WITH EACH OTHER

This application claims priority of No. 099109793 filed in Taiwan R.O.C. on Mar. 31, 2010 under 35 USC 119, the entire content of which is hereby incorporated by reference.

BACKGROUND OF THE INVENTION

1. Field of the Invention

The present invention relates in general to an image forming apparatus, and more particularly to an image forming apparatus with a top-mounted photosensitive drum and being capable of reducing wear of the photosensitive drum.

2. Related Art

In a conventional printer, the photosensitive drum, which is mounted at the side of or under the developing unit, constantly withstands a weight or a lateral locking force of the developing unit, especially when the developing unit contains a toner supplier. Therefore, the pressing contact between the photosensitive drum and the developing roller of the developing unit produces excessive friction therebetween. Consequently, the increase in friction causes rapid wear of the photosensitive film of the photosensitive drum and shortens the life of the photosensitive drum.

The toners inside the toner supplier gradually decrease as the amount of usage increases, and therefore, the toner supplier becomes lighter in weight. To maintain the contact between the developing roller and the photosensitive drum even when the least amount of the toners remains in the toner supplier, the developing roller is usually designed to press against the photosensitive drum at a high level of pressure in the case of a full tank of toners. However such high level of pressure on the photosensitive drum only accelerates a deterioration of the photosensitive drum and consequent impact on images is liable to occur.

In addition, in the situation where the developing unit is mounted in a case with a lock device pushing the developing unit towards the photosensitive drum, the increase in the pressure applied on the photosensitive drum causes the expedited deterioration as well.

SUMMARY OF THE INVENTION

Accordingly, the present invention has been proposed to solve the problems of the prior art, and it is an object of the present invention to provide an image forming apparatus with a top-mounted photosensitive drum and a resilient member, for example, a compression spring, for counteracting the weight of a developing cartridge, in order to maintain steady contact pressure between the developing roller and the photosensitive drum and to reduce the wear of the photosensitive drum.

To achieve the above-identified object, the present invention provides an image forming apparatus including a case, a photosensitive drum, a developing cartridge and a resilient member. The photosensitive drum, disposed over the developing cartridge, forms a toner image. The developing cartridge is movably disposed within the case and includes a developing tank and a developing roller. The developing roller is mounted on the developing tank and positioned opposite the photosensitive drum. The developing roller transfers toners to the photosensitive drum. The resilient member, disposed between the developing tank and the case, provides a restoring force for counteracting a weight of the developing tank and urging the developing roller towards the photosensitive drum.

The image forming apparatus of the present invention maintains a steady and tight contact between the top-mounted photosensitive drum and the developing roller without applying excessive pressure on the photosensitive drum. Therefore, no abnormal tear and wear will be produced on the photosensitive drum, and endurability of the photosensitive drum is remarkably improved.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

DETAILED DESCRIPTION OF THE INVENTION

Figure 1:
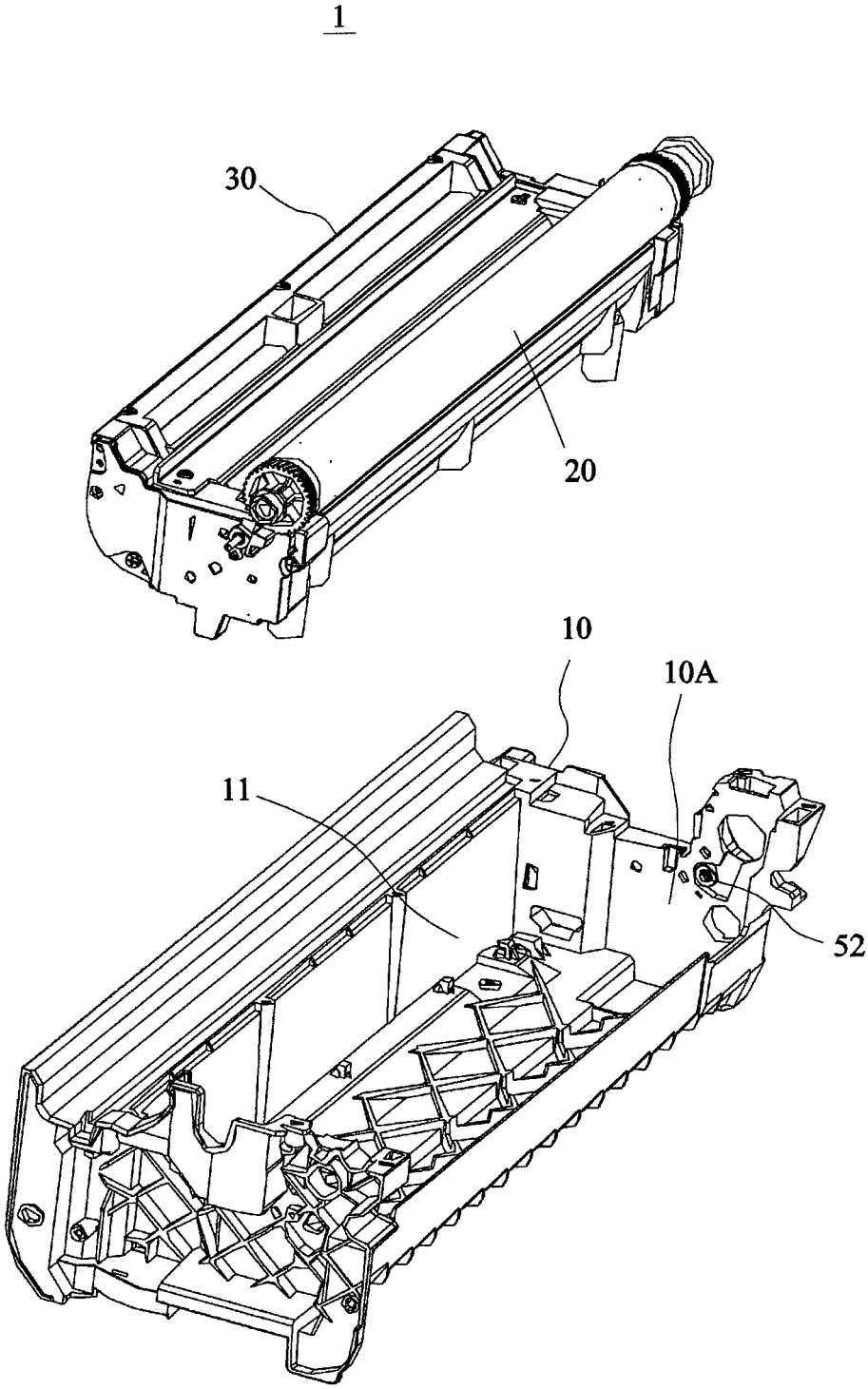
FIG. 1 is an exploded pictorial view of an image forming apparatus according to a first embodiment of the present invention.

FIG. 1 is an exploded pictorial view of an image forming apparatus 1 according to a first embodiment of the present invention. Referring to FIG. 1, the image forming apparatus 1 includes a case 10, a photosensitive drum 20 and a developing cartridge 30. The photosensitive drum 20, disposed over the developing cartridge 30, forms a toner image. The developing cartridge 30 is accommodated within a chamber 11 of the case 10. A roller 52 is rotatable and mounted on a sidewall of the chamber 11.

Figure 2:
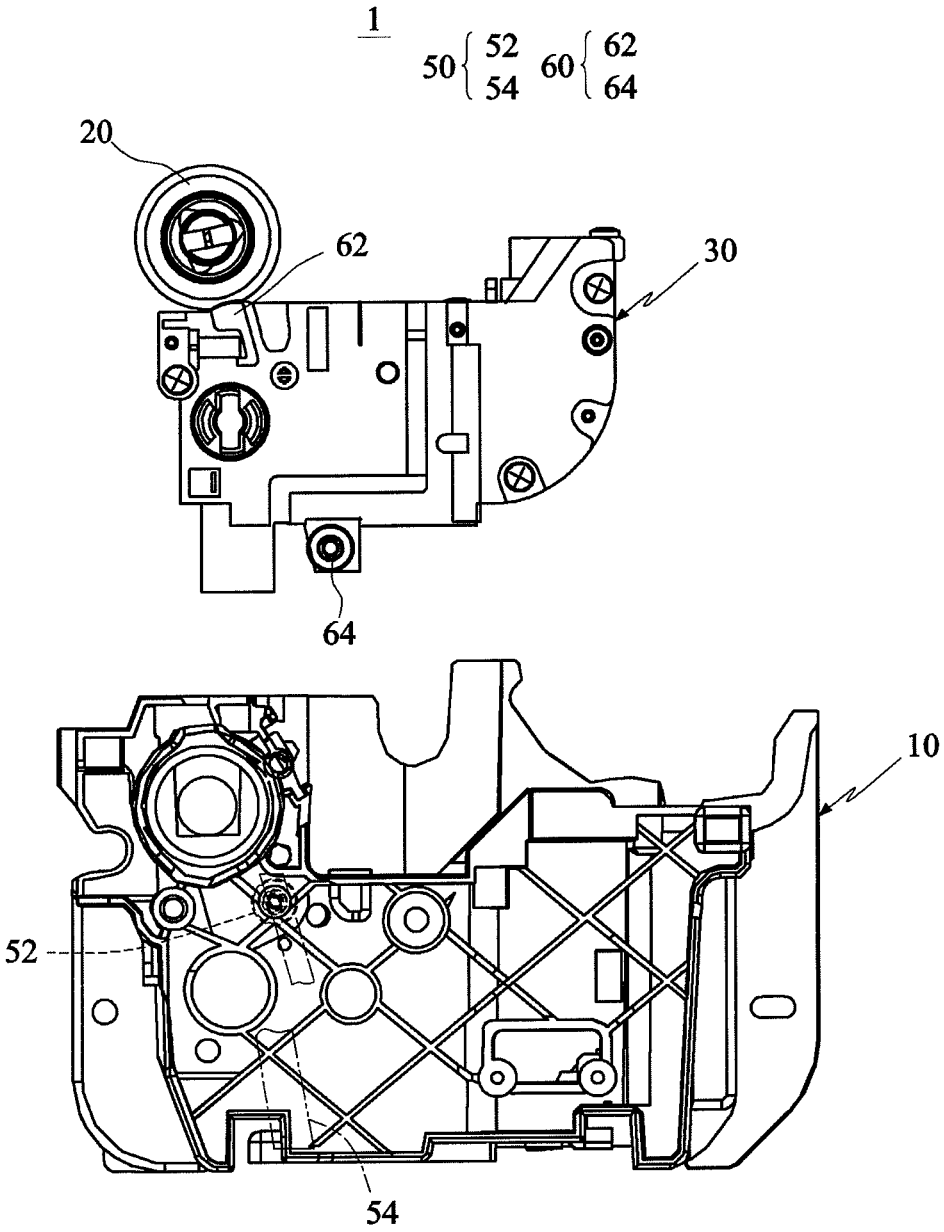
FIG. 2 is an exploded side view of the image forming apparatus according to the first embodiment of the present invention.
Figure 3:
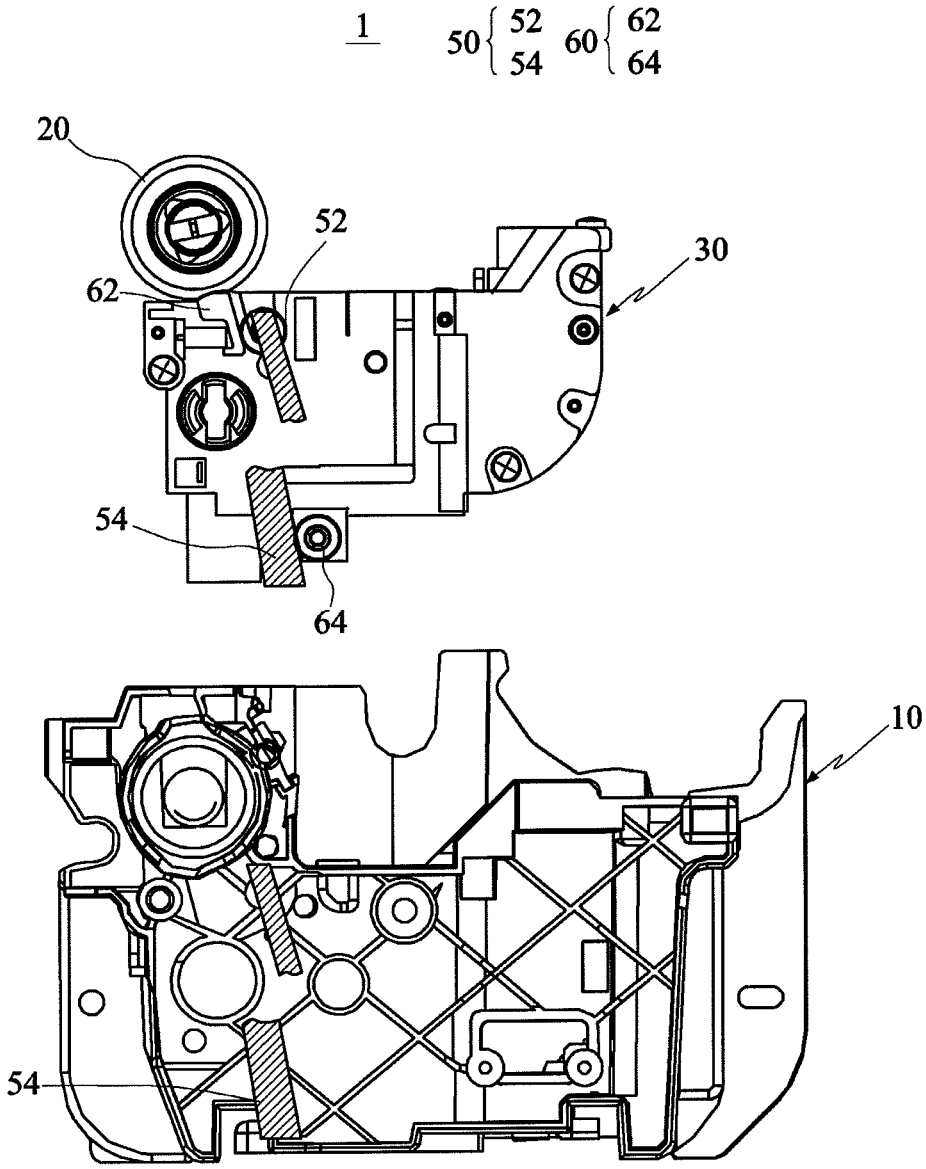
FIG. 3 is a simplified drawing of FIG. 2.

FIG. 2 is an exploded side view of the image forming apparatus 1 according to the first embodiment of the present invention. As shown in FIG. 2, the roller 52 is depicted in dashed lines. FIG. 3 is a simplified drawing of FIG. 2. In FIG. 3, the case 10 is shown in a simplified form, omitting parts of its structure non-essential in this present invention, in order to improve visibility of a supporting member set 50 (to be described later) depicted in phantom lines of FIG. 2. In addition, for the convenience of illustration of the interactions between the roller 52 and a first force-exerting member 62 of a force-exerting member set 60 and between a guiding block 54 and a second force-exerting member 64 of the force-exerting member set 60, the roller 52 and the guiding block 54 of the supporting member set 50 are drawn together on the developing cartridge 30 instead.

Figure 4:
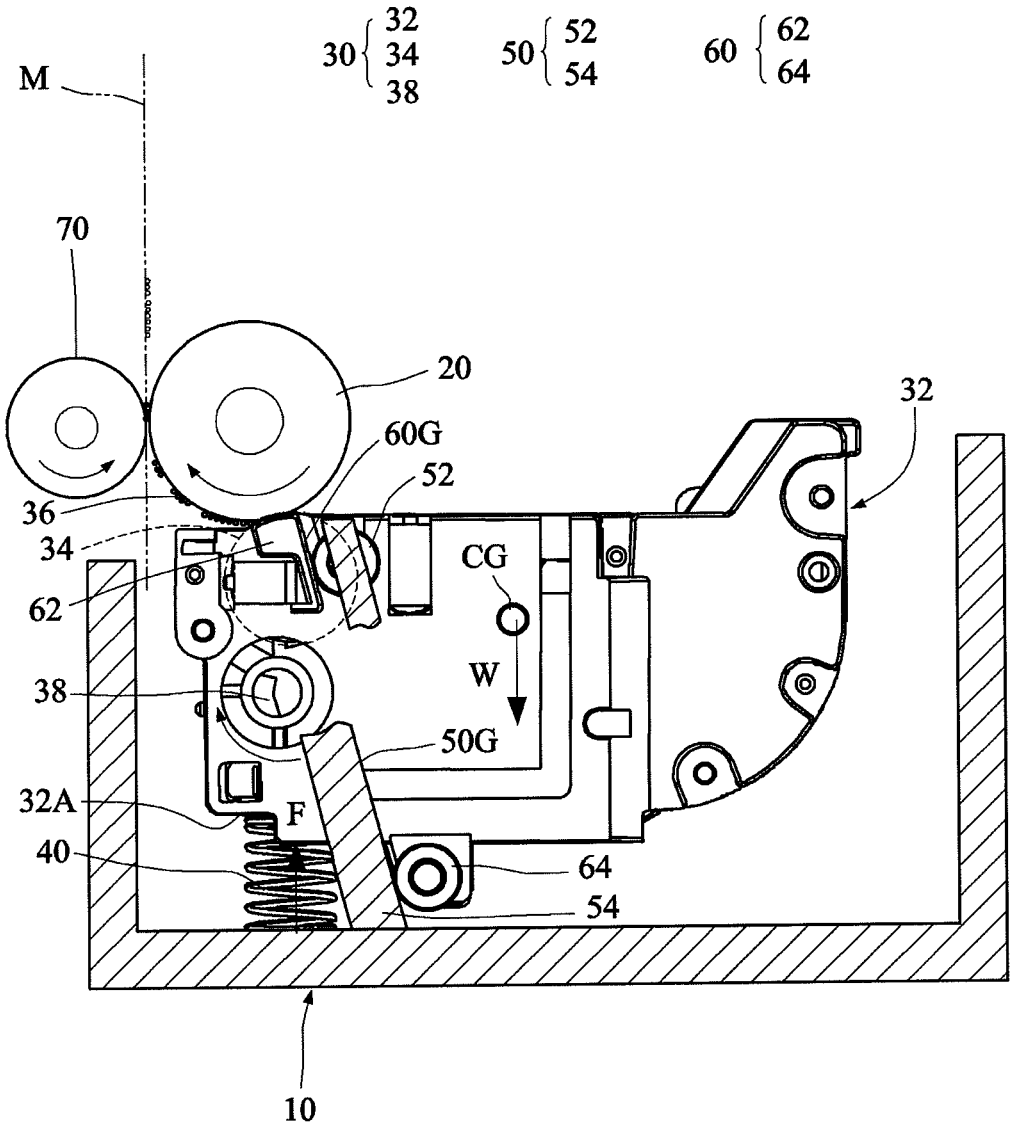
FIG. 4 is a side view of the image forming apparatus according to the first embodiment of the present invention.
Figure 5:
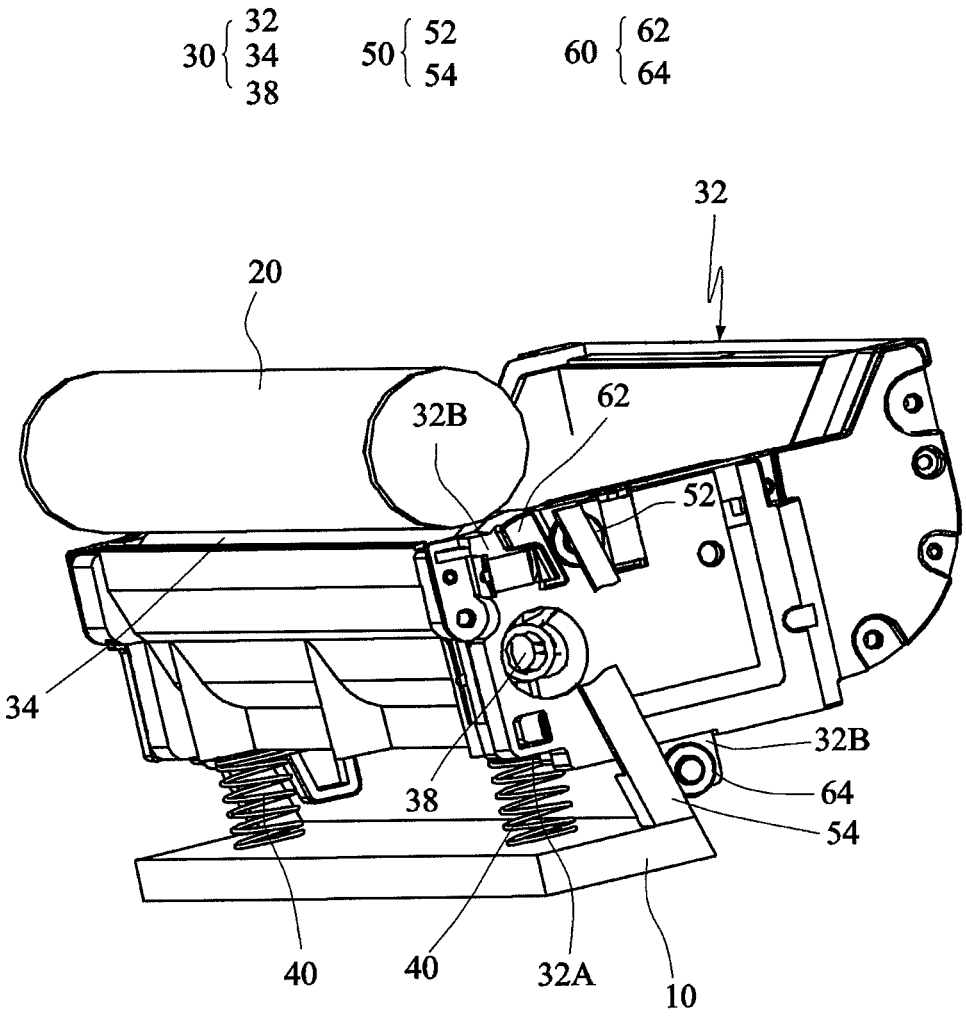
FIG. 5 is a partial pictorial view of the image forming apparatus according to the first embodiment of the present invention.

FIG. 4 is a side view of the image forming apparatus 1 according to the first embodiment of the present invention, where the developing cartridge 30 is movably disposed within the case 10. FIG. 5 is a partial pictorial view of the image forming apparatus 1 according to the first embodiment of the present invention. As shown in FIG. 4, the case 10 is represented by a frame, for the sake of illustration. The image forming apparatus 1 of this embodiment includes the case 10, the photosensitive drum 20, the developing cartridge 30 and a resilient member 40.

The image forming apparatus 1 for printing data on a sheet may be installed in a printer, a copier or a multi-function device, for example. The photosensitive drum 20 is rotatable and mounted on the case 10.

The developing cartridge 30, movably disposed within the case 10, includes a developing tank 32, a developing roller 34 and a rotation shaft 38. The developing roller 34, mounted on the developing tank 32 and positioned opposite the photosensitive drum 20, transfers toners 36 to the photosensitive drum 20. The toners 36, stored in a toner supplier (not shown) attached to the developing tank 32, are transferred to the photosensitive drum 20 by the rotating developing roller 34.

The resilient member 40, which may be a compression spring, is disposed between the developing tank 32 and the case 10. One or more resilient member 40 may be provided. In this embodiment, two resilient members 40 are disposed at the two opposite ends of the developing tank 32, as shown in FIG. 5. The resilient members 40 are disposed under a bottom 32A of the developing tank 32. The resilient member 40 provides a restoring force F for counteracting a weight W of the developing tank 32 and urging the developing roller 34 towards the photosensitive drum 20. The resilient members 40 are disposed to one side of the center of gravity CG of the developing tank 32 and on the same side as the developing roller 34. Such a configuration alleviates the load, caused by the weight of the developing tank 32, on the photosensitive drum 20 and effectively reduces the wear of the photosensitive drum 20.

The force-exerting member set 60 interacts with the supporting member set 50 to maintain steady contact pressure between the developing roller 34 and the photosensitive drum 20. The supporting member set 50, disposed on an inner wall 10A of the case 10 (see FIG. 1), includes a first supporting member 52 and a second supporting member 54. The force-exerting member set 60 is disposed on an outer wall 32B of the developing tank 32. The first force-exerting member 62 and the second force-exerting member 64 are positioned correspondingly to the positions of the first supporting member 52 and the second supporting member 54, respectively. The image forming apparatus 1 may further include a transfer roller 70 for transferring the toner image to a medium M transported past the nip between the transfer roller 70 and the photosensitive drum 20.

In this embodiment, the first supporting member 52 is the roller 52 and the second supporting member 54 is the guiding block 54; and the first force-exerting member 62 is a guiding block 62 and the second force-exerting member 64 is a roller 64. When the developing tank 32 is swinging, the guiding block 62 and the roller 64 respectively exert forces on the roller 52 and the guiding block 54. The guiding block 54 and the roller 64 respectively have guiding structures 50G and 60G. The guiding structure 50G may be a track disposed or formed on the walls of the case 10. The roller 52 and the guiding block 62 may roll or slide on the guiding structures 60G and 50G. In this embodiment, each of the supporting member set 50 and the force-exerting member set 60 includes a guiding structure and a roller, but the invention is not restricted thereto. In another embodiment, the supporting member set 50 may include two guiding structures, and the force-exerting member set 60 may include two rollers, working in conjunction with the two guiding structures of the supporting member set 50. Alternatively, another type of component, such as sliding blocks, may also be used as long as the same function is achieved.

The resilient member 40 serves as a fulcrum for the developing tank 32. The weight W of the developing tank 32 produces a clockwise moment, which causes the force-exerting member set 60 to exert a force on the supporting member set 50 of the case 10. However, a reaction force by the supporting member set 50 with respect to the force exerted by the force-exerting member set 60 counterbalances the moment induced by the weight W of the developing tank 32. In other words, the interactions between the first force-exerting member 62 and the first supporting member 52 and between the second force-exerting member 64 and the second supporting member 54 counterbalance the moment induced by the weight W of the developing tank 32, to keep the case 10 and the developing cartridge 30 in the equilibrium state.

The rotation shaft 38, inserted through the developing tank 32, supports the developing tank 32 and drives the developing roller 34 to rotate and supply the toners 36 to the photosensitive drum 20. The rotation shaft 38 is the rotation axis of the developing tank 32, and the resilient member 40 is located on the rotation axis.

Figure 6:
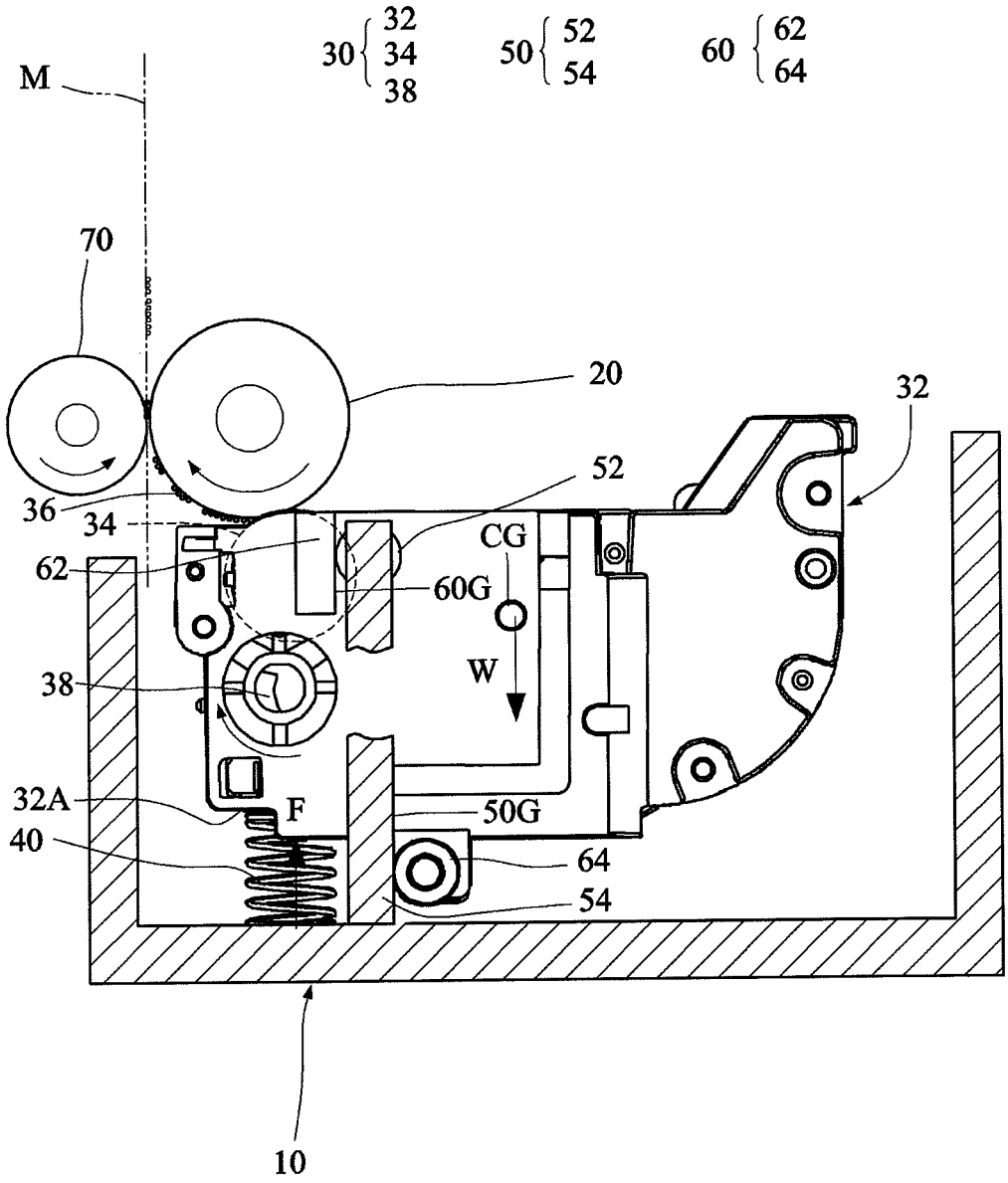
FIG. 6 is a side view of an image forming apparatus according to a second embodiment of the present invention.

FIG. 6 is a side view of an image forming apparatus 1' according to a second embodiment of the present invention. As shown in FIG. 6, this embodiment is similar to the first embodiment except for the following differences. In the first embodiment, the guiding structure 50G of the supporting member set 50 includes an inclined guiding plane, and the roller 64 of the force-exerting member set 60 exerts the force on the inclined guiding plane, and rolls or slides on the inclined guiding plane. In the second embodiment, however, the guiding structure 50G of the supporting member set 50 includes a guiding plane extending in the direction of gravity, and the roller 64 of the force-exerting member set 60 exerts a force on the guiding plane and rolls or slides on the surface in the direction of gravity.

Therefore, the top-mounted photosensitive drum of the present invention is different from the conventional photosensitive drum mounted at the side of or under the developing unit, and is free from the problem of the unstable contact condition of the photosensitive drum and the developing roller caused by the weight of the developing tank or the improper support to the developing tank. The image forming apparatus of the present invention reduces the wear of the photosensitive drum and improves the endurability of the photosensitive drum.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. An image forming apparatus, comprising:

a case;

a photosensitive drum for forming a toner image;

a developing cartridge, movably disposed within the case, comprising:

a developing tank; and a developing roller, mounted on the developing tank and positioned opposite the photosensitive drum, for transferring toners to the photosensitive drum;

a supporting member set, disposed on an inner wall of the case;

a force-exerting member set, disposed on an outer wall of the developing tank, wherein the force-exerting member set interacts with the supporting member set to maintain steady contact pressure between the developing roller and the photosensitive drum; and a resilient member, disposed between the developing tank and the case, for providing a restoring force for counteracting a weight of the developing tank and urging the developing roller towards the photosensitive drum, wherein the photosensitive drum is disposed over the developing cartridge.

2. The apparatus according to claim 1, wherein the resilient member is disposed under a bottom of the developing tank.

3. The apparatus according to claim 1, wherein the supporting member set comprises a first supporting member and a second supporting member, and the force-exerting member set comprises a first force-exerting member and a second force-exerting member, wherein the first force-exerting member and the second force-exerting member are positioned correspondingly to positions of the first supporting member and the second supporting member, respectively.

4. The apparatus according to claim 3, wherein interactions between the first force-exerting member and the first supporting member and between the second three-exerting member and the second supporting member counterbalance a moment induced by the weight of the developing tank.

5. The apparatus according to claim 1, wherein at least one of the supporting member set and the force-exerting member set comprises a guiding structure.

6. The apparatus according to claim 5, wherein the guiding structure of the supporting member set comprises a guiding plane extending in a direction of gravity, and the fore-exerting member set exerts a force on the guiding plane.

7. The apparatus according to claim 5, wherein the guiding structure of the supporting member set comprises an inclined guiding plane, and the force-exerting member set exerts a force on the inclined guiding plane.

8. The apparatus according to claim 1, wherein at least one of the supporting member set and the force-exerting member set comprises a roller.

9. The apparatus according to claim 1, wherein the developing cartridge further comprises a rotation shaft, inserted through the developing tank, for supporting the developing tank and driving the developing roller.

10. The apparatus according to claim 9, wherein the rotation shaft is a rotation axis of the developing tank, and the resilient member is located on the rotation axis.

11. The apparatus according to claim 1, wherein the resilient member is disposed to one side of a center of gravity of the developing tank and on the same side as the developing roller.

* * * * *